US008544611B2

(12) United States Patent
Ogava

(10) Patent No.: US 8,544,611 B2
(45) Date of Patent: Oct. 1, 2013

(54) ELEVATOR SAFETY SYSTEM WITH BAR TO PREVENT SHAFT ENTRY

(75) Inventor: Mario Yoshitaro Ogava, Randolph, NJ (US)

(73) Assignee: Inventio AG, Hergiswil (CH)

( * ) Notice: Subject to any disclaimer, the term of this patent is extended or adjusted under 35 U.S.C. 154(b) by 954 days.

(21) Appl. No.: 12/620,728

(22) Filed: Nov. 18, 2009

(65) Prior Publication Data

US 2011/0114423 A1 May 19, 2011

(51) Int. Cl.
*B66B 13/00* (2006.01)

(52) U.S. Cl.
USPC ..... 187/314

(58) Field of Classification Search
CPC ..... B66B 13/00
USPC ..... 187/313, 314; 49/54, 56
See application file for complete search history.

(56) References Cited

U.S. PATENT DOCUMENTS

| | | | | |
|---|---|---|---|---|
| 355,384 | A | 1/1887 | Chinnock | |
| 777,612 | A | 12/1904 | Eaton | |
| 3,461,422 | A | 8/1969 | Hansen | |
| 4,982,814 | A | 1/1991 | Hussey | |
| 6,446,759 | B1 * | 9/2002 | Kulak et al. | 187/330 |
| 7,114,594 | B2 * | 10/2006 | Rossignol et al. | 187/336 |
| 2008/0078626 | A1 | 4/2008 | Kocher | |

FOREIGN PATENT DOCUMENTS

| | | | |
|---|---|---|---|
| JP | 04055287 A | * | 2/1992 |
| JP | 05116876 A | * | 5/1993 |
| WO | 9635630 | | 11/1996 |

OTHER PUBLICATIONS

English Translation of JP 05-116876 A.*

* cited by examiner

*Primary Examiner* — William E Dondero
*Assistant Examiner* — Diem Tran
(74) *Attorney, Agent, or Firm* — Wolff & Samson, PC

(57) ABSTRACT

A safety system for an elevator has a bar mounted on a landing door, the bar being adapted to extend into a passageway of the landing door, and a holding member adapted to prevent the bar from extending into the passageway of the landing door when a car door is positioned correctly behind the landing door. The bar is adapted to extend into the passageway when the landing door is opened and when the holding member does not prevent the bar from extending into the passageway of the landing door.

13 Claims, 3 Drawing Sheets

ELEVATOR SAFETY SYSTEM WITH BAR TO PREVENT SHAFT ENTRY

BACKGROUND OF THE INVENTION

The invention relates to an elevator safety system, in particular to a safety system for passengers in proximity of landing doors.

An elevator is usually mounted in a shaft of a building. Along such a shaft, there are a number of landings allowing access to the shaft from different floors of the building. The elevator includes a car, a counterweight, a load bearing member, a drive unit, and landing doors. The car and the counterweight are movably suspended in the shaft. The load bearing member is associated with the car, the drive unite, and the counterweight. The drive unit drives the load bearing member and, thus, moves the car and the counterweight in the shaft up and down in opposite directions.

The elevator is configured to stop at landings such that passengers can enter or leave the car. Unless a car is positioned at a landing, the landing doors are closed and prevent passengers from entering the shaft. A certain landing door only opens if the car is positioned correctly behind that landing door, and if a passenger requested to enter or leave the car at that landing door. In most elevators, the car has a car door which only opens if an adjacent landing door opens. Usually, the car door and the adjacent landing door are coupled such that only one door drive is necessary, and that the car door and the landing door open simultaneously.

Even though the landing doors prevent, e.g., passengers from entering the shaft when the car is not positioned correctly behind a certain landing door, entries through landing doors into the shaft occur and may result in fatal accidents. In many elevators, landing doors can be opened from the landing with a key, for example, with a three-square socket wrench. Technicians need to enter the shaft for revision or for maintenance of the elevator, but anybody having a suitable key at hand can enter the shaft from the landing.

In order to prevent such entries, U.S. Pat. No. 4,982,814 discloses a safety barricade. A heavy duty plate is mounted in facing plates on each side of an elevator opening.

SUMMARY OF THE INVENTION

Accordingly, a need exists to further develop the above described elevator safety barricades. Further, there is a need to provide an elevator safety system that helps to reduce fatal accidents caused by the described access through landing doors.

Accordingly, one aspect involves a safety system for an elevator. The safety system for an elevator has a bar mounted on a landing door, the bar being adapted to extend into a passageway of the landing door, and a holding member adapted to prevent the bar from extending into the passageway of the landing door when a car door is positioned correctly behind the landing door. The bar is adapted to extend into the passageway when the landing door is opened and when the holding member does not prevent the bar from extending into the passageway of the landing door.

In one embodiment, the safety system includes an opening member adapted to displace the bar. The opening member is advantageously adapted to pretension the bar.

In one embodiment, the bar remains in a first position in which the bar extends into the passageway of the landing door, and in a second position in which the bar does not extend into the passageway of the landing door. The bar is substantially horizontal in the first position, and substantially vertical in the second position.

Preferably, the safety system does not depend on electric power in order to function. In case of a power failure, landing doors may still be opened, e.g., with a three-square socket wrench. It is, therefore, advantageous that the safety system functions without electric power.

Another aspect involves an elevator with an elevator safety system advantageously provided at each landing door of the elevator. However, it is also possible to equip only landing doors that are especially prone to fatal entries.

Another aspect involves a method of preventing persons approaching an open landing door without a car positioned correctly behind the landing door from accessing an elevator shaft. The method includes extending a bar into a passageway of the landing door when the landing door is opened while the car is not positioned correctly behind the landing door.

In one embodiment, the method further includes holding the bar out of the passageway of the landing door if the car is positioned correctly behind the landing door.

In a preferred embodiment, the bar in a first position extends substantially horizontally into the passageway of the landing door, and the bar in a second position extends substantially vertically along the landing door without extending into the passageway of the landing door. The bar pivots around a pivot from the second position to the first position when the door is opened and while the car is not positioned correctly behind the landing door.

BRIEF DESCRIPTION OF THE DRAWINGS

The novel features and method steps characteristic of the invention are set out in the claims below. The invention itself, however, as well as other features and advantages thereof, are best understood by reference to the detailed description of specific embodiments, which follows, when read in conjunction with the accompanying drawings, wherein:

DETAILED DESCRIPTION OF THE INVENTION

Figure 1:
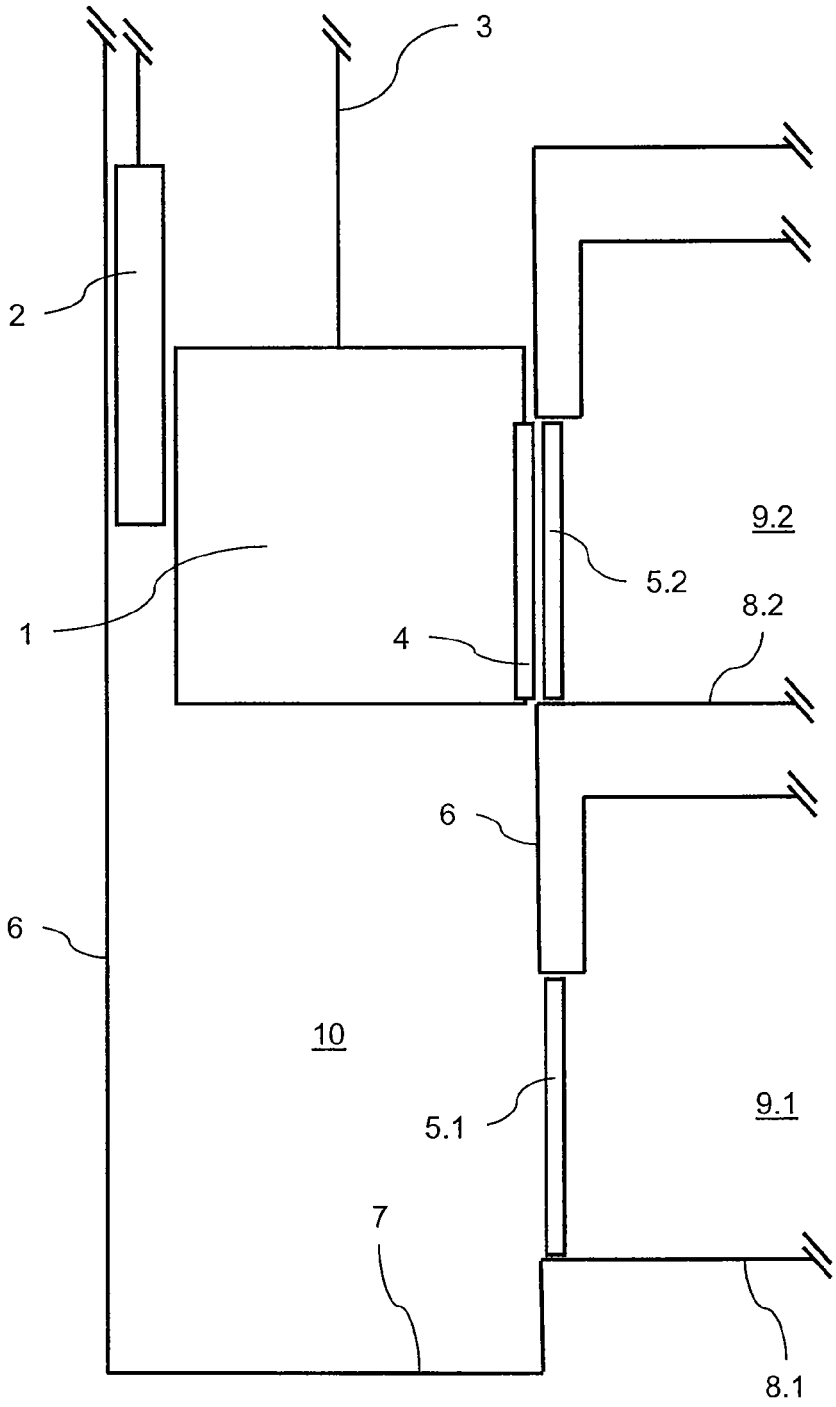
FIG. 1 is a schematic drawing showing an elevator, wherein a car is positioned at a landing door.

FIG. 1 shows an elevator associated with a building and having a car 1, a counterweight 2, and a load bearing member 3. The car 1 and the counterweight 2 are suspended on the load bearing member 3. The car 1 and the counterweight 2 can move upwards and downwards in a shaft 10. The shaft 10 is bounded by a shaft floor 7 and shaft walls 6.

FIG. 1 further shows a lower landing 9.1 and an upper landing 9.2. Each landing has a landing floor 8.1, 8.2 and a landing door 5.1, 5.2. The car 1 is positioned at the upper landing 9.2. In this exemplary embodiment, the car 1 has a car door 4. The car door 4 and the upper landing door 5.2 are adjacent to each other such that they can be opened simultaneously in order to allow passengers to enter or leave the car 1.

The elevator in FIG. 1 is a schematic representation which does not show all components of an elevator. The person skilled in the art will appreciate that several possible arrangements of an elevator exist: For example, the number of landings may be varied from two to one hundred or more, depending on the number of floors of the corresponding building. The arrangement of the car 1 and the counterweight 2 in the shaft 10 can be varied. There can be more than one car 1 in the same shaft 10. The car 1 and the counterweight 2 can be suspended on the load bearing member 3 directly or on pulleys. The car 1 can be configured without a car door 4. The embodiments described herein are therefore not limited to one specific configuration of an elevator. The described embodiments are applicable to almost any kind of elevator that has landing doors 5.1, 5.2.

Figure 2:
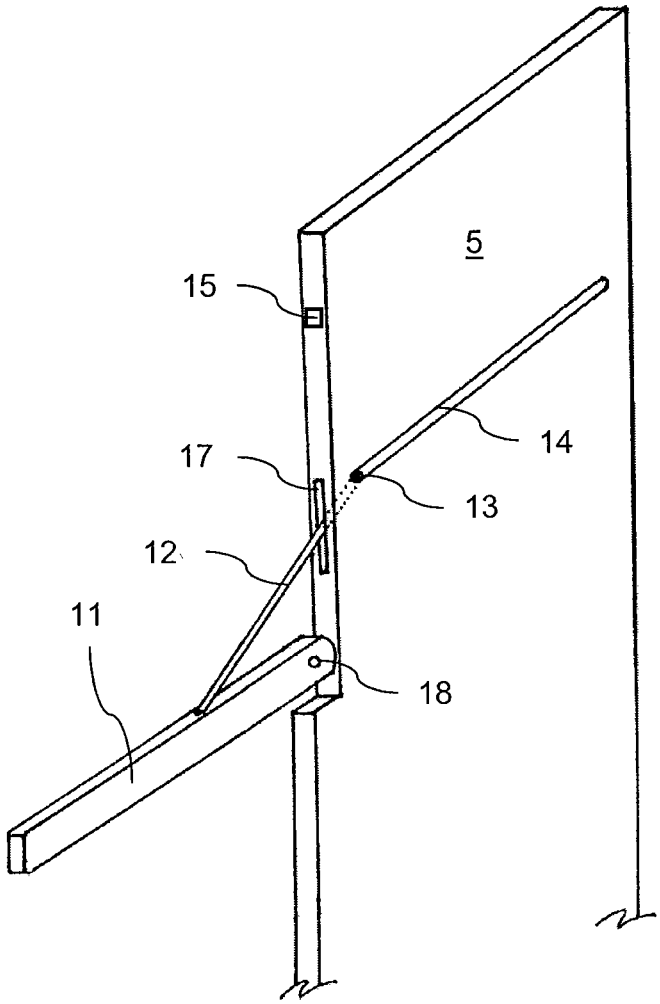
FIG. 2 is a schematic drawing showing a landing door with a safety system in a first position.
Figure 4:
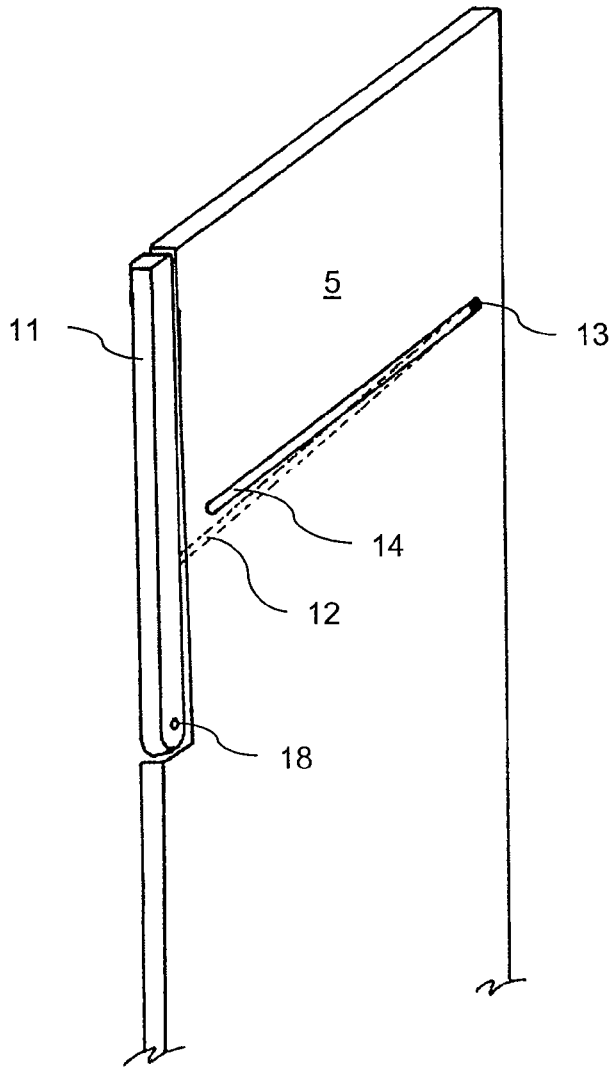
FIG. 4 is a schematic drawing showing a landing door with a safety system in a second position.

A exemplary embodiment of a safety system for elevators is shown in FIGS. 2 and 4. In FIG. 2, the safety system is in a first position, and in FIG. 4, the safety system is in a second position. In the first position, a passageway of the landing door 5 is barred, whereas in the second position, the passageway is free. The safety system can be transferred from the first position into the second position and vice versa.

The exemplary embodiment of the safety system for elevators shown in FIG. 2 and FIG. 4 is mounted on the landing door 5. The landing door 5 shown in this embodiment comprises one door panel. The person skilled in the art will appreciate that a number of landing doors may be used, including landing doors with multiple panels or landing doors with panels on both sides.

The safety system for elevators comprises a bar 11. The bar 11 is mounted on a side of the landing door 5 facing a passageway of the landing door 5. A pivot 18 connects the bar 11 to the landing door 5, and allows the bar 11 to pivot from the first position to the second position.

In FIG. 2, the bar 11 is in the first position. The bar 11 extends substantially horizontally from the landing door 5 into the passageway of the landing door. In this first position, passengers are barred from passing through the passageway of the landing door.

In FIG. 4, the bar 11 is in the second position. The bar 11 extends substantially vertically along the landing door 5, such that the passageway of the landing door is free, and persons can pass through the landing door.

An auxiliary arm 12 connects the bar 11 with a traction pin 13. The traction pin 13 is slidably engaged in a guiding slot 14 in the landing door 5. The auxiliary arm 12 extends from the traction pin 13 through an opening 17 to the bar 11. The guiding slot 14 limits the pivoting angle of the bar 11. As shown in FIG. 2, the guiding slot 14 is preferably configured so that the bar 11 is limited to pivot downwards when it reaches a substantially horizontal position (first position). As seen in FIG. 4, the guiding slot 14 is preferably configured so that the bar 11 is limited to pivot away from the passageway when it has reached a substantially vertical position (second position).

An opening member 15 is configured to pretension the bar 11 when it is in the second position. In one embodiment, the opening member 15 has a spring element.

Figure 3:
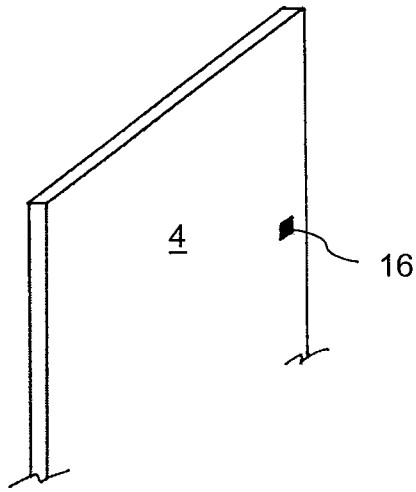
FIG. 3 is a schematic drawing showing a car door.

FIG. 3 shows an exemplary embodiment of a car door 4. The car door has a holding member 16. The holding member 16 is adapted to retain the traction pin 13 when the car door 4 and the landing door 5 are positioned adjacent to each other, i.e., when the car 1 is positioned correctly at the landing 9.2 (see FIG. 1). If the car 1 is not positioned correctly at a landing 9, which is the case for the landing 9.1 in FIG. 1, then the traction pin 13 of the landing door 5.1 is not retained such that the bar 11 is free to pivot from the second position to the first position.

The holding member 16 preferably has a magnet that is adapted to retain magnetic material in the traction pin 13. Alternatively, the holding member 16 is configured to retain the traction pin 13 mechanically, e.g., with a hook.

The safety system for elevators is configured such that the bar 11 extends into the passageway of the landing door 5 only if the car 1 is not positioned correctly behind the landing door 5 and if the landing door 5 is opened. An exemplary embodiment of a safety system in its activated state, i.e., in its first position, is shown in FIG. 2. In all other cases, the safety system remains in its inactive state, i.e., in its second position, as shown in FIG. 4.

The combination of pivotable bar 11, auxiliary arm 12, traction pin 13 slidably engaged in a guiding slot 14, opening member 15, and holding member 16 shown in FIGS. 2, 3 and 4 is one exemplary embodiment that enables the above described function of the safety system: The holding member 16 holds the traction pin 13 in its second position (FIG. 4) as long as the car door 4 is positioned correctly behind the landing door 5. The opening member 15 pretensions the bar 11 while the bar 11 is in the second position (FIG. 4).

In case the car door 4 with the holding member 16 moves away from the landing door 5, the traction pin 13 is no longer held by the holding member 16, while the bar 11 is still pretensioned by the opening member 15. If the landing door 5 is opened, the pretensioned bar 11 pivots from the second position (FIG. 4) to the first position (FIG. 2). The pivoting movement of the bar 11 is limited by the movement of the traction pin 13 in the guiding slot 14, as the bar 11 is connected to the traction pin 13 by the auxiliary arm 12.

The person skilled in the art will appreciate that a number of alternative embodiments can be realized without departing from the spirit of the present invention. For example, the bar 11 can be realized as a horizontally moving element that is hidden in the landing door 5 in its inactive state and slid into the passageway of the landing door 5 when activated. The opening member 15 in this alternative example is a spring that preloads the bar 11 while the bar 11 is hidden in the landing door 5. An alternative traction pin 13 is directly mounted to the bar 11, such that an auxiliary arm 12 is not necessary in this alternative embodiment.

Figure 5:
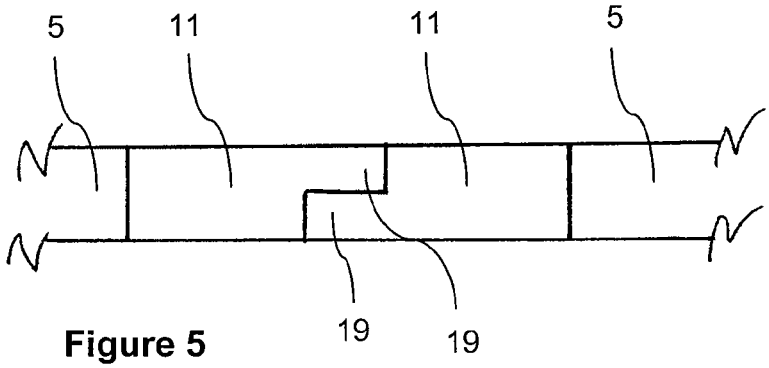
FIG. 5 is a schematic drawing showing a landing door with a safety system in a second position in top view.

FIG. 5 shows an exemplary embodiment of the safety system, in which the landing door 5 comprises two door panels. Each door panel has a bar 11 mounted to a side of the door panel facing the passageway of the landing door 5. In this embodiment, each bar 11 occupies half of the passageway when the safety system is in its activated state (i.e. first position, see FIG. 2).

A side facing the passageway of each bar 5 has an extension 19, the extensions fitting into each other. These extensions ensure that there is no gap when the landing door 5 is closed.

What is claimed is:

1. A safety system for an elevator, the safety system comprising:

a bar mounted on a landing door, the bar being adapted to extend into a passageway in which the landing door travels; and a holding member adapted to prevent the bar from extending into the passageway in which the landing door travels when a car door is positioned correctly behind the landing door;

an arm that connects the bar to a traction pin, the traction pin being slidably engaged in a guiding slot, the arm and traction pin located parallel with the landing door, wherein the bar is adapted to extend into the passageway in which the landing door travels when the landing door is opened and when the holding member does not prevent the bar from extending into the passageway in which the landing door travels.

2. The safety system according to claim 1, further comprising an opening member adapted to displace the bar from a second position, in which the bar does not extend into the passageway in which the landing door travels, to a first position, in which the bar extends into the passageway in which the landing door travels.

3. The safety system according to claim 2, wherein the opening member is adapted to pretension the bar while the bar is in the second position.

4. The safety system according to claim 1, wherein the traction pin is adapted to be held by the holding member and wherein the holding member is mounted on a car door.

5. The safety system according to claim 4, wherein the holding member includes a magnet that is adapted to hold the traction pin in a predetermined position.

6. The safety system according to claim 1, wherein the bar is mounted on a side of the landing door facing the passageway in which the landing door travels.

7. The safety system according to claim 1, wherein the bar is adapted to remain in a first position, in which the bar extends into the passageway in which the landing door travels, and in a second position, in which the bar does not extend into the passageway in which the landing door travels.

8. The safety system according to claim 7, wherein the bar is substantially horizontal in the first position, and wherein the bar is substantially vertical in the second position.

9. An elevator comprising an elevator safety system, the elevator safety system comprising:

a bar mounted on a landing door, the bar being adapted to extend into a passageway in which the landing door travels;

an arm connecting the bar to a traction pin, the arm and the traction pin located parallel with the landing door; and a holding member adapted to prevent the bar from extending into the passageway in which the landing door travels when a car door is positioned correctly behind the landing door, wherein the bar is adapted to extend into the passageway in which the landing door travels when the landing door is opened and when the holding member does not prevent the bar from extending into the passageway in which the landing door travels.

10. A method of preventing persons approaching an open landing door without a car positioned correctly behind said landing door from accessing an elevator shaft, comprising:

extending a bar into a passageway in which the landing door travels when the landing door is opened while the car is not positioned correctly behind the landing door, wherein an arm connects the bar to a traction pin, and wherein a holding member holds the traction pin in a predetermined position if the car is positioned correctly behind said landing door, the arm and the traction pin located parallel with the landing door.

11. The method according to claim 10, further comprising holding the bar out of the passageway in which the landing door travels if the car is positioned correctly behind said landing door.

12. The method according to claim 10, wherein the bar in a first position extends substantially horizontally into the passageway in which the landing door travels, and wherein the bar in a second position extends substantially vertically along the landing door without extending into the passageway in which the landing door travels.

13. The method according to claim 12, further comprising pivoting the bar around a pivot from the second position to the first position when the door is opened and while the car is not positioned correctly behind the landing door.

* * * * *